US007261585B2

(12) United States Patent
Yamanashi et al.

(10) Patent No.: US 7,261,585 B2
(45) Date of Patent: Aug. 28, 2007

(54) PRESS-CONTACT CONNECTOR

(75) Inventors: Makoto Yamanashi, Haibara-gun (JP); Takashi Muro, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/072,398

(22) Filed: Mar. 7, 2005

(65) Prior Publication Data

US 2006/0199423 A1 Sep. 7, 2006

(51) Int. Cl.
*H01R 4/24* (2006.01)

(52) U.S. Cl. ..... 439/404; 439/417

(58) Field of Classification Search ..... 439/404, 439/417–419, 395, 701
See application file for complete search history.

(56) References Cited

U.S. PATENT DOCUMENTS

| | | | | |
|---|---|---|---|---|
| 5,320,555 | A * | 6/1994 | Okabe | 439/354 |
| 5,498,172 | A * | 3/1996 | Noda | 439/404 |
| 5,520,550 | A * | 5/1996 | Okabe | 439/404 |
| 5,536,182 | A * | 7/1996 | Atoh et al. | 439/404 |
| 5,664,963 | A * | 9/1997 | Yamamoto et al. | 439/409 |
| 5,713,756 | A * | 2/1998 | Abe | 439/404 |
| 5,766,033 | A * | 6/1998 | Davis | 439/405 |
| 5,833,486 | A * | 11/1998 | Shinozaki | 439/404 |
| 6,062,896 | A * | 5/2000 | Huang | 439/405 |
| 6,210,204 | B1 * | 4/2001 | Ko et al. | 439/404 |
| 6,273,745 | B1 * | 8/2001 | Yeh | 439/404 |
| 6,520,794 | B2 * | 2/2003 | Liao | 439/418 |
| 6,932,640 | B1 * | 8/2005 | Sung | 439/405 |
| 6,969,272 | B2 * | 11/2005 | Sakamoto et al. | 439/397 |
| 2005/0106927 | A1 * | 5/2005 | Goto et al. | 439/404 |

FOREIGN PATENT DOCUMENTS

| | | |
|---|---|---|
| JP | 62-062766 | 4/1987 |
| JP | 63-8063 | 3/1988 |
| JP | 64-56152 | 4/1989 |
| JP | 6-76868 A | 3/1994 |
| JP | 7-27057 | 5/1995 |
| JP | 09-161857 A | 6/1997 |
| JP | 09-223528 A | 8/1997 |
| JP | 09-283193 A | 10/1997 |
| JP | 10-275639 A | 10/1998 |
| JP | 11-045745 A | 2/1999 |
| JP | 11-067289 A | 3/1999 |
| JP | 2000-12109 A | 1/2000 |

* cited by examiner

*Primary Examiner*—Hien Vu
(74) *Attorney, Agent, or Firm*—Sughrue Mion, PLLC

(57) ABSTRACT

A press-contact connector 10 has a first member 20 which accommodates a plurality of terminals 21 having press-contact blades 21*a* and a second member 30 which is attached to the first member 20 and holds a plurality of wires 11 in an aligned state. The second member 30 has a plurality of retaining portions 31 capable of retaining the wires 11 respectively, formed in an approximate U shape and arranged in parallel to one another. The retaining portion 31 has claw portions 33 which are provided at inner walls 32 to lock the wire 11 in such a way as to contact with a bottom portion 31*a* of the retaining portion 31, and lances 34 which are provided at serial directional ends of each retaining portion 31 to urge the wire 11 in the direction of the opening of the retaining portion 31 in a cross section. Since each wire 11 is held bent by the cooperation of the claw portions 33 with the lances 34, compatibility with automation is possible and the wires 11 can be held sufficiently.

5 Claims, 15 Drawing Sheets

PRESS-CONTACT CONNECTOR

BACKGROUND OF THE INVENTION

1. Field of the Invention

The present invention relates to a press-contact connector which electrically connects wires to terminals by inserting press-contact blades into the wires.

2. Related Art

There have existed press-contact connectors for electrically press-connecting cables inserted into a press-contact block to press-contact portions of terminals as shown in Unexamined Japanese Patent Publication No. 2000-12109. As shown in FIG. 15, this press-contact connector 100 has a terminal block 102, which accommodates a plurality of terminals 101 for press-contacting individual cables to electrically conduct them, and a press-contact block 104 having cable insertion holes 103 for insertion of the cables and set in parallel to the terminal block 102 so that it can be relatively moved close to the terminal block 102 in translation.

To facilitate the cable insertion, it includes inclination holding units 105, 106 and 107 capable of releasably holding the press-contact block 104 in an inclined state with respect to the terminal block 102, and parallel holding units 108 and 109 capable of releasably holding the press-contact block 104 in a parallel state with respect to the terminal block 102.

A box-like dent 110 is provided at one side (the left-hand side in FIG. 15) of the terminal block 102, and the plural terminals 101 are provided inside the dent 110 at predetermined pitches.

A large recess 111 is formed on the other side (the right-hand side in FIG. 15) of the terminal block 102, and the terminals 101 are aligned in parallel and secured in the recess 111, with the root sides of the terminals 101 being bent upward to form press-contact portions 101*a* and laid out zigzag.

A press-contact connector for discrete wires, which connects discrete wires to terminals is disclosed in Unexamined Japanese Patent Publication Hei. 6-76868. As shown in FIG. 16, this press-contact connector 120 includes a body portion 122 having press-contacting contacts 121*a* and 121*b* and a press-contact cover 124 having a guiding unit respective wires 123 to be connected at positions corresponding to the press-contacting contacts 121*a* and 121*b*.

As shown in FIG. 17, multiple projections 125 are provided, for example, zigzag at an inner surface 124*a* of the press-contact cover 124, and the wires 123 run zigzag through the projections 125, thereby holding the wires 123.

Therefore, as the wires 123 are held between the body portion 122 and the press-contact cover 124 and the press-contact cover 124 is put over the body portion 122, the individual wires 123 are held in electrical contact with the press-contacting contacts 121*a* and 121*b*.

Because the press-contact connector 100 disclosed in Unexamined Japanese Patent Publication No. 2000-12109 should have wires inserted from the cable insertion holes 103 of the press-contact block 104, compatibility with automation is difficult, bringing about such an inconvenience that manual wiring is troublesome.

Since the wires 123 are bent between the projections 125 to secure the holding force at the time of holding the discrete wires 123 at the press-contact cover 124 according to the invention of the press-contact connector 120 disclosed in Unexamined Japanese Patent Publication Hei. 6-76868, it is difficult to attach the wires 123.

SUMMARY OF THE INVENTION

The present invention has been made in consideration of the problems, and it is an object to provide a press-contact connector which can be made compatible for automation and can sufficiently hold wires.

To achieve the object, according to the invention, there is provided a press-contact connector comprising a first member which accommodates a plurality of terminals; a plurality of press-contact blades connected to the terminals and protruding from a top surface of the first member; and a second member which is attached to the first member in such a way as to cover the press-contact blades and holds a plurality of wires to press-contact with the press-contact blades in an aligned state, characterized in that the second member has a plurality of retaining portions capable of retaining the wires respectively, formed in an approximate U shape and arranged in parallel to one another, and claw portions which are provided at inner walls of the retaining portions to hold the wires in the retaining portions, and the wires are connected to the press-contact blades in a bent state in the retaining portions.

Possible examples of the wires are, for example, individually discrete wires and a cable or the like with end portions only separated.

According to the press-contact connector constructed in this manner, wires held at the second member are pressed with the press-contact blades of the terminals retained in the first member.

At this time, wires which can be made compatible for automation are used and are held in parallel by plural U-shaped retaining portions provided at the second member. In the retaining portion, each wire is held in a bent state by the claw portion provided at the inner wall.

Therefore, the press-contact connector can be made compatible for automation and can sufficiently hold wires, and can thus overcome the conventional problem that compatibility with automation is difficult.

The invention is characterized in that lances are provided at serial directional ends of the retaining portions to urge the wires toward openings of the retaining portions in the cross section.

According to the press-contact connector constructed in this manner, as wires are held in a bent state by cooperation of the claw portions of the retaining portions and the lances, the wires can be held reliably.

The invention is characterized in that the lances are provided at both serial directional ends of each of the retaining portions.

According to the press-contact connector constructed in this manner, because wires are bent by the lances provided at both front and rear end portions of the retaining portions, sufficient wire holding force can be attained.

The invention is characterized in that the retaining portions have bulging portions which can hold the wires in a bent state.

According to the press-contact connector constructed in this manner, as wires can be held bent by the bulging portions provided at the retaining portions, the wires can be held reliably.

The invention is characterized in that the bulging portions bulge in a press-contacting direction of the press-contact blades.

According to the press-contact connector constructed in this manner, because the retaining portion has the bulging portion bulging in the press-contacting direction, the wire is bent toward the bulging portion to be connected to the press-contact blade. Accordingly, the wires can be held reliably.

The invention is characterized by having temporary engagement lock members capable of temporarily locking the second member with respect to the first member, and actual engagement lock members capable of actually locking the second member with respect to the first member from a temporarily locked state.

According to the press-contact connector constructed in this manner, the second member is temporarily locked at the first member by the temporary engagement lock members and is actually locked by the actual engagement lock members from the temporary engagement state, so that after wires compatible for automation are wired automatically, wires which cannot be made compatible for automation in a temporarily locked state can be wired manually.

The invention can overcome the conventional problem such that because of an inability to be made compatible for automation, wiring should be done manually, and brings about an effect that sufficient wire holding force can be secured.

DETAILED DESCRIPTION OF THE PREFERRED EMBODIMENTS

Embodiments of the invention will now be described in detail with reference to the accompanying drawings.

Figure 1:
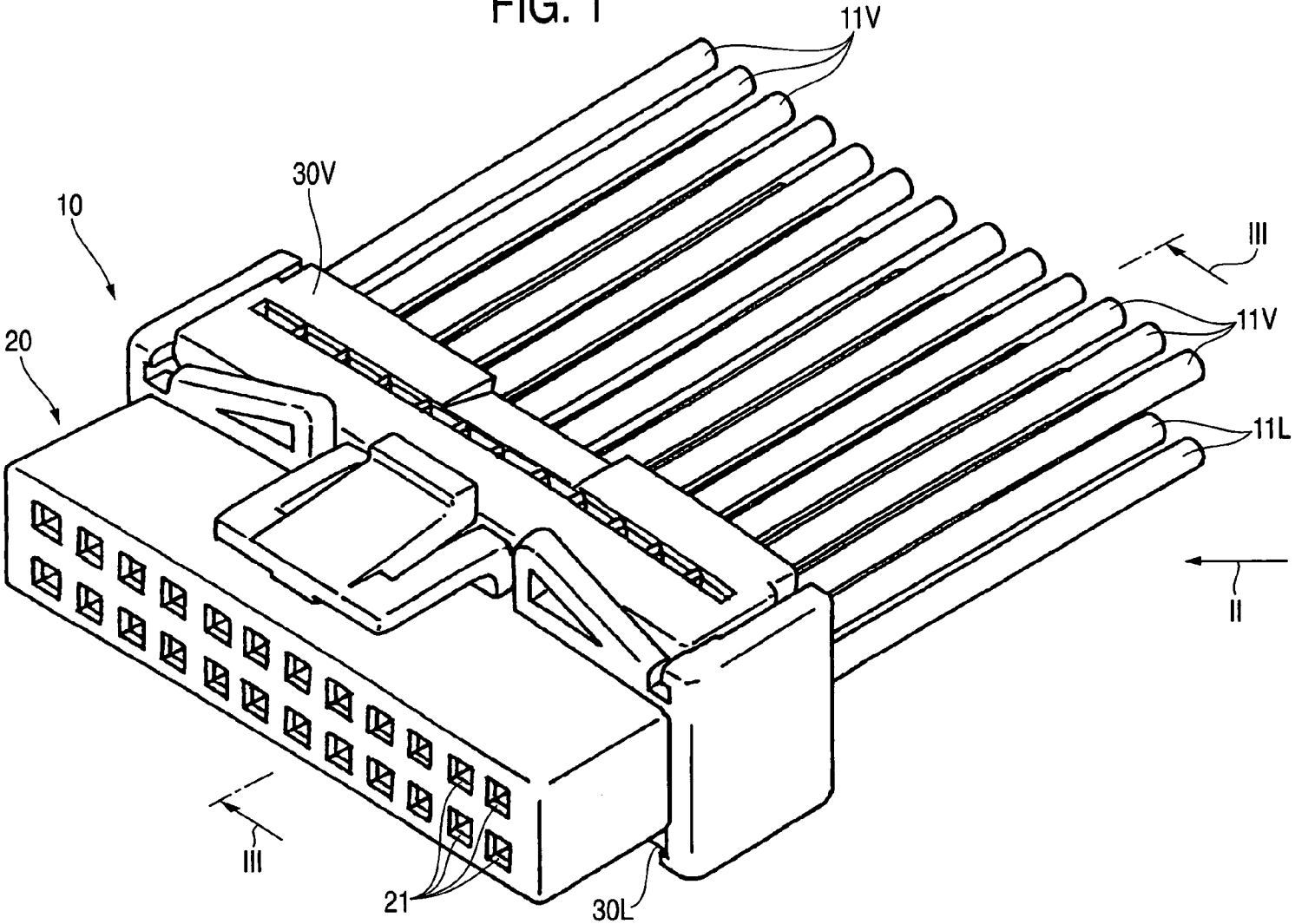
FIG. 1 is a perspective view showing the first embodiment of the invention.
Figure 2:
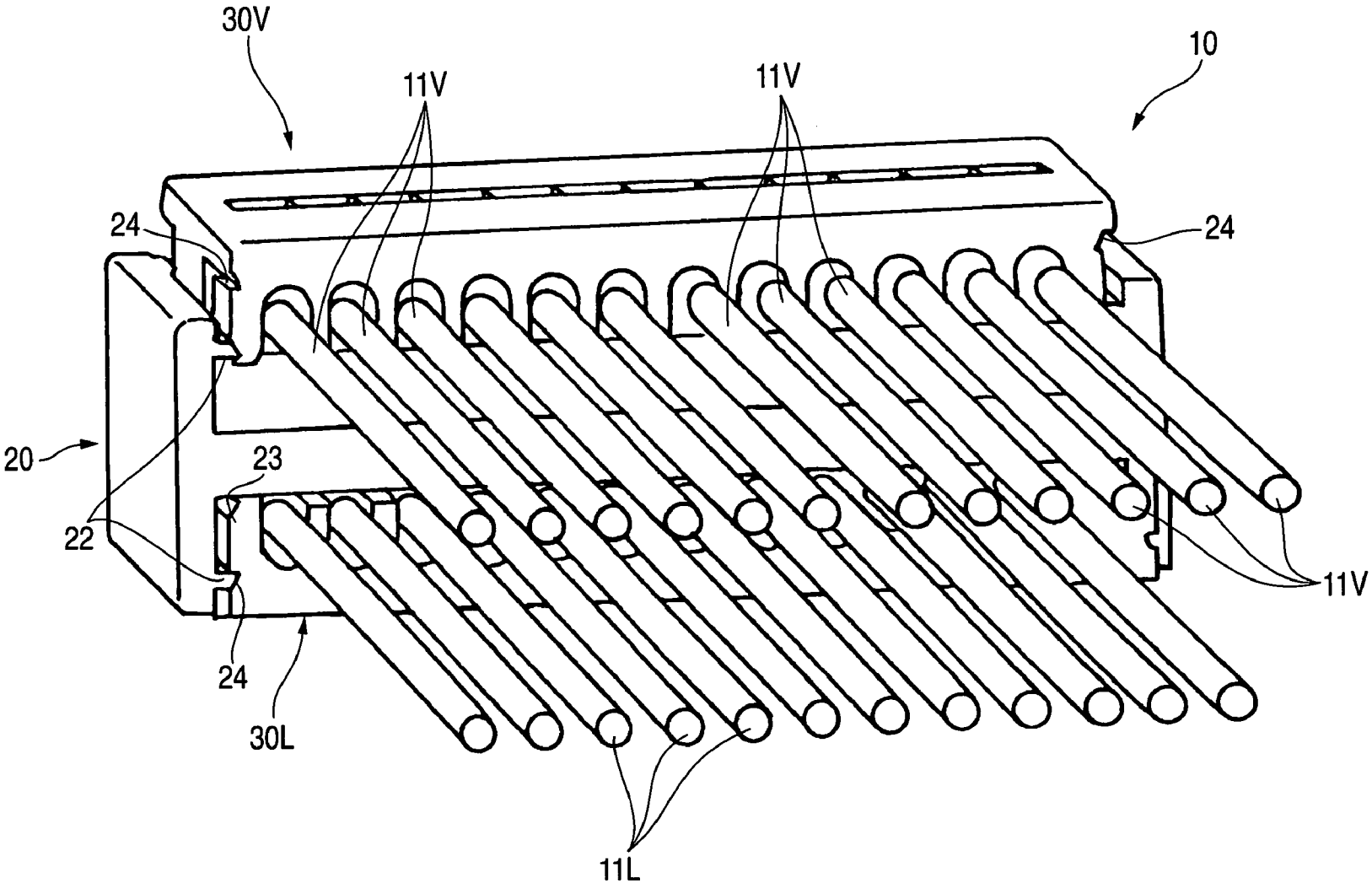
FIG. 2 is a perspective view as seen from the direction II in FIG. 1.

As shown in FIG. 1 and FIG. 2, a press-contact connector 10 according to a first embodiment of the invention has a housing 20 as the first member, and a cover 30 as the second member to be attached to the housing 20. While it has a pair of upper and lower covers 30U and 30L, for example, either one will do.

Figure 3:
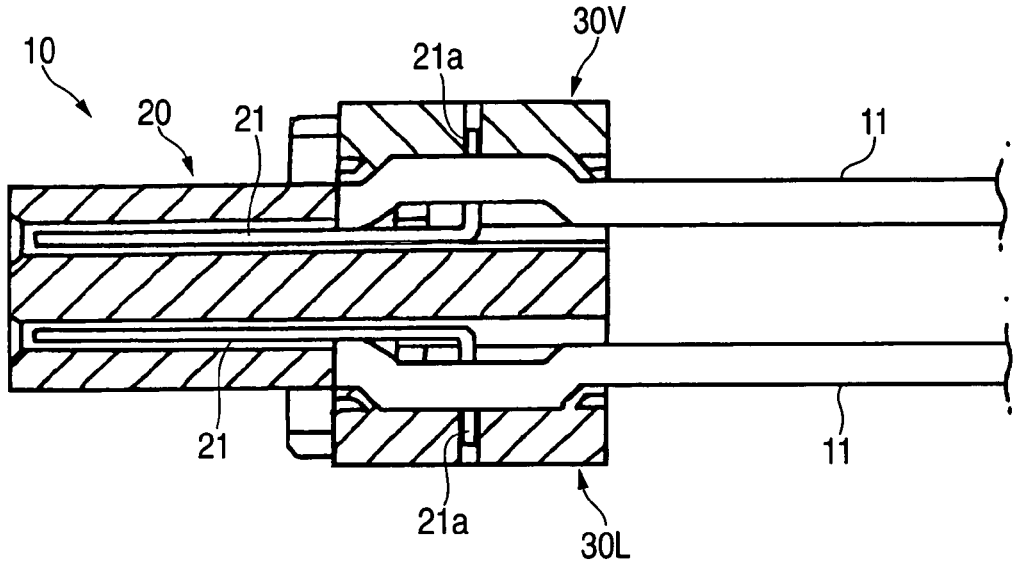
FIG. 3 is a cross-sectional view at the position III-III in FIG. 1.

A plurality of terminals 21 are retained in the housing 20, and a plurality of press-contact blades 21*a* connected to the respective terminals are provided protruding from a top surface 20*a* of the housing 20 (see FIG. 3). Here, the housing 20 is provided with two stages of upper and lower terminals 21 in association with the pair of upper and lower covers 30U and 30L.

The covers 30U and 30L hold plural wires 11 to be press-contacted to the respective press-contact blades 21*a* in an aligned state.

As shown in FIG. 2, there are provided temporary engagement lock member which temporarily locks the covers 30U and 30L at temporary engagement positions with respect to the housing 20 in such a way as to cover the press-contact blades 21*a*, and actual engagement lock member which finally secures the covers 30U and 30L to the housing 20.

The temporary engagement lock units can be, for example, engagement projections 22 provided at the housing 20, and temporary engagement recesses 23 provided at the covers 30U and 30L.

The actual engagement lock units can be the engagement projections 22 provided at the housing 20, and actual engagement recesses 24 provided at the covers 30U and 30L.

Figure 4:
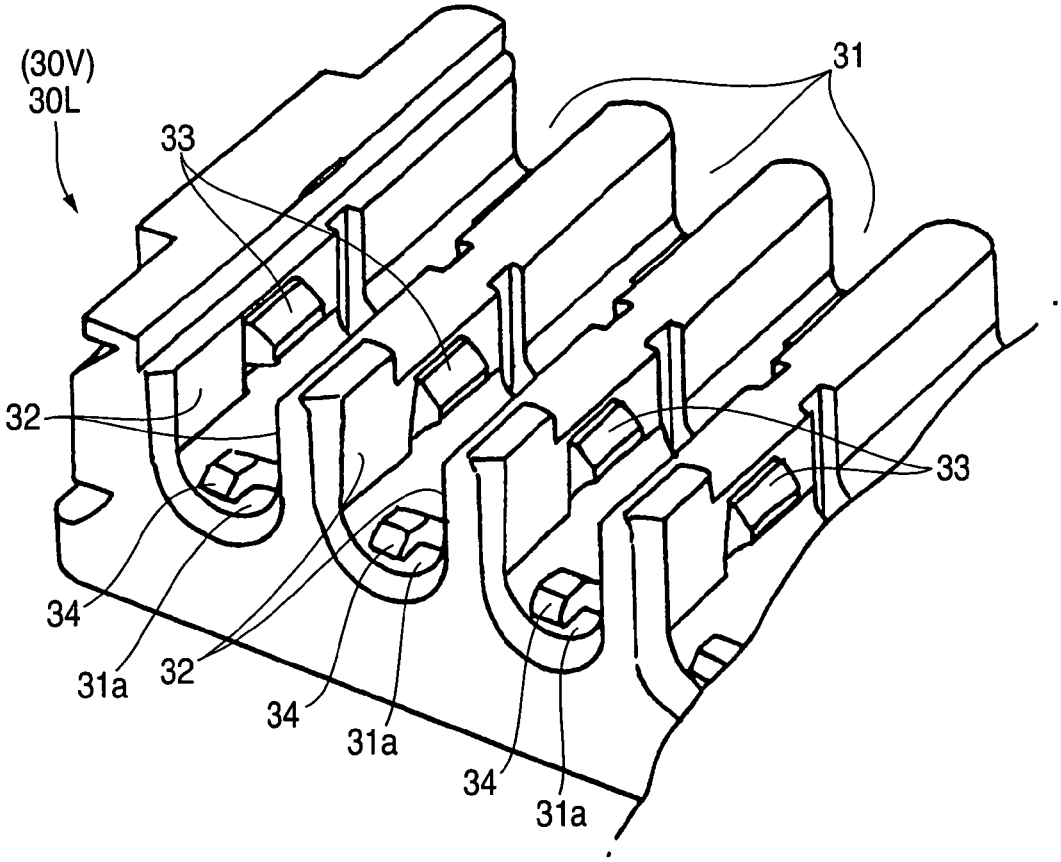
FIG. 4 is a perspective view of the second member.

As shown in FIG. 4, for example, the cover 30L has a plurality of retaining portions 31, formed in an approximate U shape, laid out in parallel to one another and capable of respectively retaining the wires 11, and the cover 30L is open at the upper portion.

Although not illustrated, the upper cover 30U is open at the lower portion.

Claw portions 33 which lock the wire 11 in such a way as to contact with a bottom portion 31*a* of each retaining portion 31 are provided at left and right inner walls 32 of the retaining portion 31.

Lances 34 and 34, which urge the wire 11 in the direction of the opening of each retaining portion 31 in a cross section, are provided at both serial directional ends of the retaining portion 31.

Figure 5:
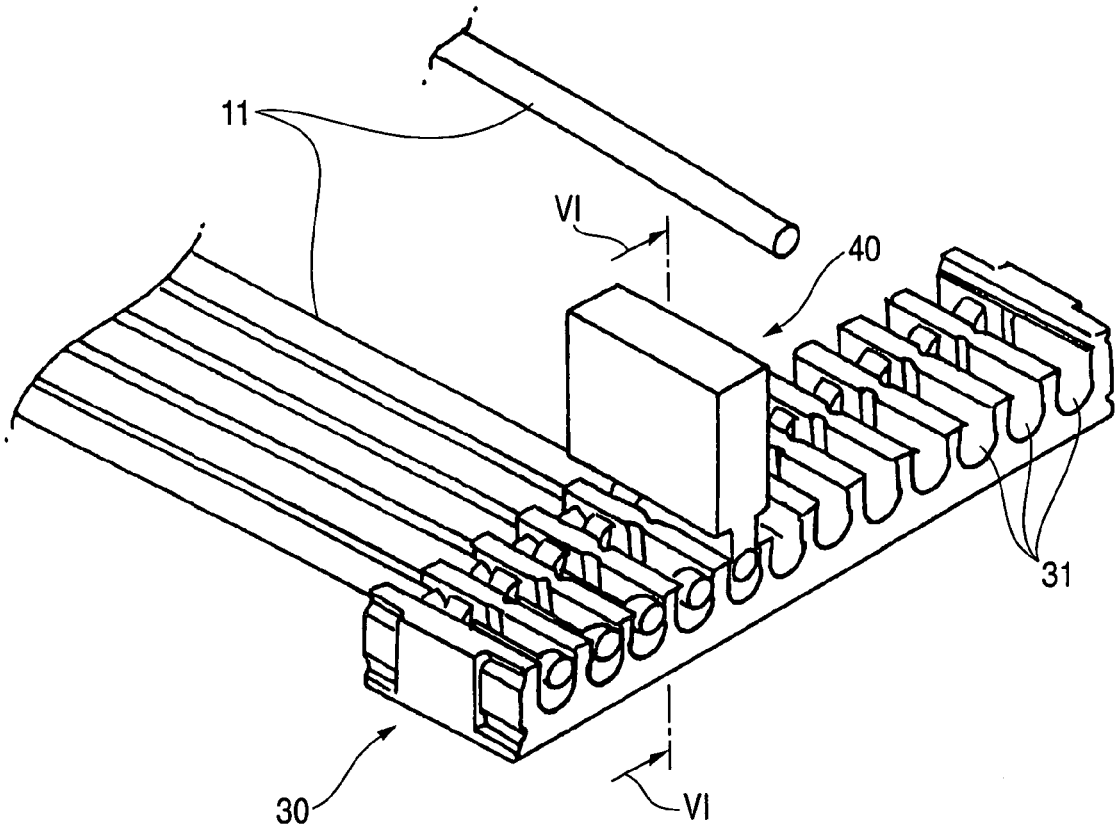
FIG. 5 is a perspective view showing a state in which wires are attached to the second member.

To lay the wires 11 in the retaining portions 31 of the covers 30U and 30L, therefore, the wires 11 are set above the retaining portions 31 of the cover 30L first, as shown in FIG. 5.

Figure 6:
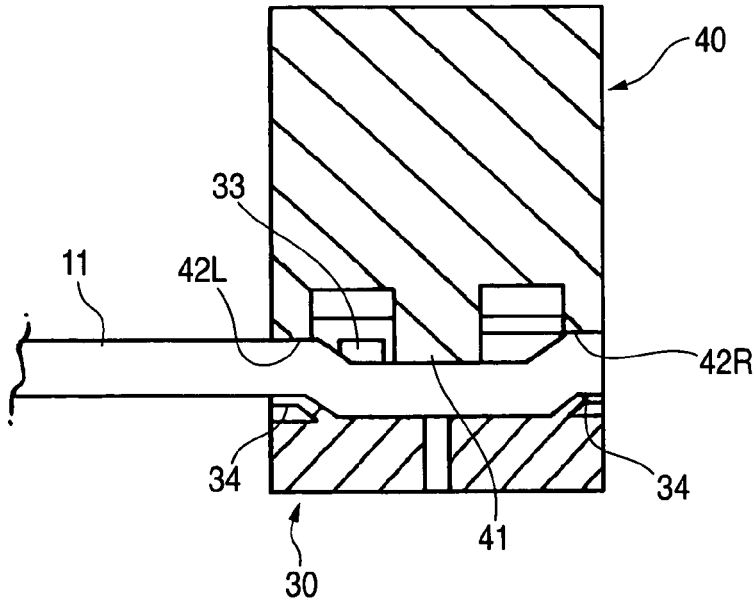
FIG. 6 is a cross-sectional view at the position VI-VI in FIG. 5.

Then, the wires 11 are pressed into the retaining portions 31 using a jig punch 40 until the wires 11 contact with the bottom portions 31*a*, as shown in FIG. 5 and FIG. 6.

The lower-end center 41 of the jig punch 40 protrudes as compared with left and right end portions 42L and 42R, so that when the tips of the end portions 42L and 42R press the wire 11 against the lance 34, the lower-end center 41 presses the wire 11 against the bottom portion 31*a* of the retaining portion 31 of the cover 30.

Then, the covers 30U and 30L holding the wires 11 are covered over and pressed against the top and bottom surfaces of the housing 20 to press-contact the wires 11 to the press-contact blades 21*a*, thereby securing the covers 30U and 30L to the housing 20.

Accordingly, the wires 11 are placed on the lances 34 at the front and rear end portions of the cover 30 and are positioned below the claw portions 33 provided at the inner walls 32 of the retaining portions 31 at the center of the cover 30, so that the wires 11 are bent.

While FIG. 5 illustrates a case where the wires 11 are laid out in the retaining portions 31 one by one, the entirety of wires can be pressed into the retaining portions 31 by automation.

According to the press-contact connector 10, therefore, the wires 11 in the retaining portions 31 are held in a state bent in a U shape by the cooperation of the lances 34 and 34 with the claw portions 33, so that the wires 11 can be held at the cover 30 with sufficient holding force, and can be press-contacted to the terminals 21 reliably.

As it can be made compatible for automation, the working efficiency can be improved.

The press-contact connector 10 can be easily inserted into not only the wires made compatible for automation but also wires which cannot be made compatible for automation.

Figure 7:
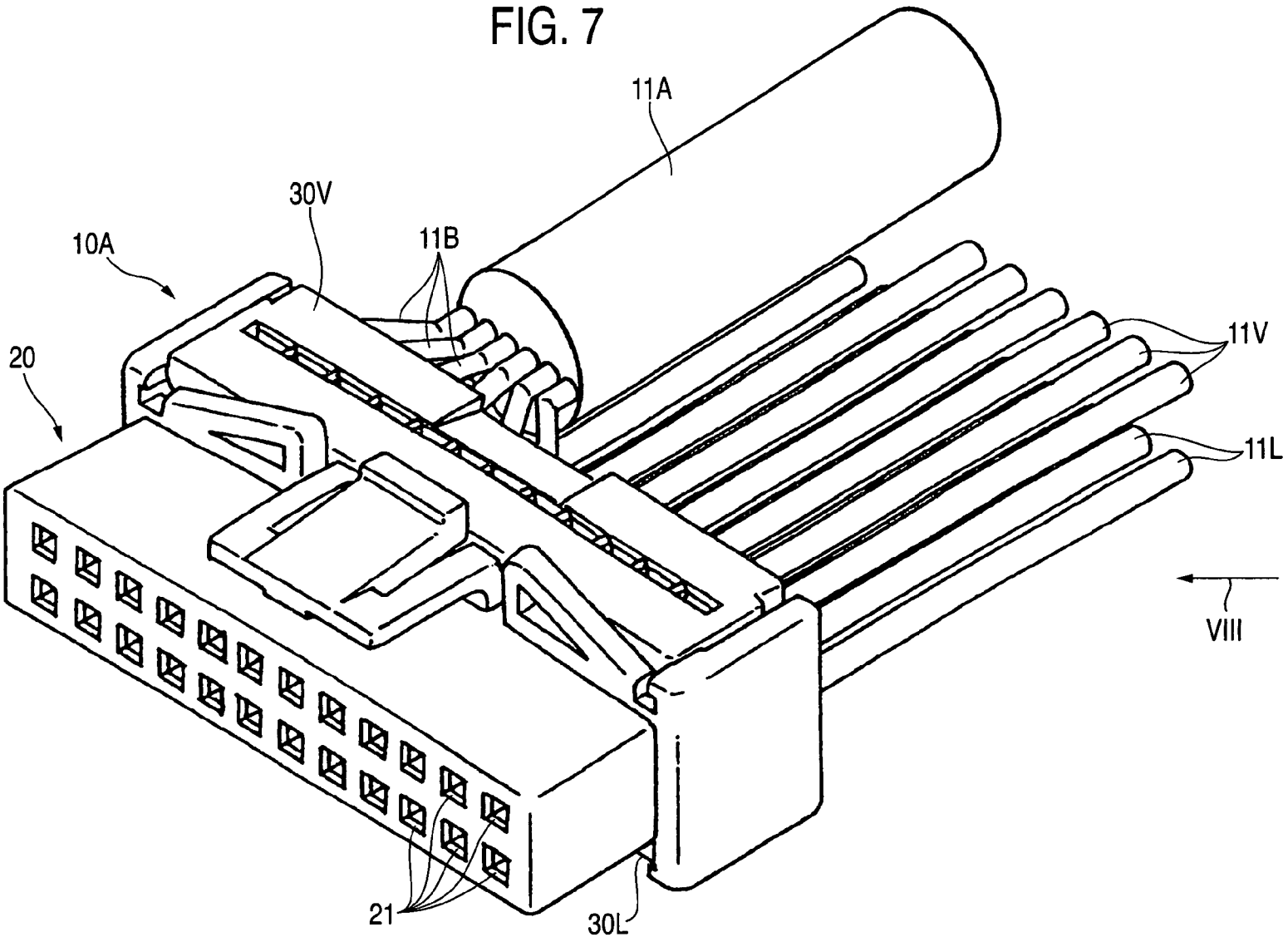
FIG. 7 is a perspective view showing a case where some of the upper wires are not compatible for automation.
Figure 8:
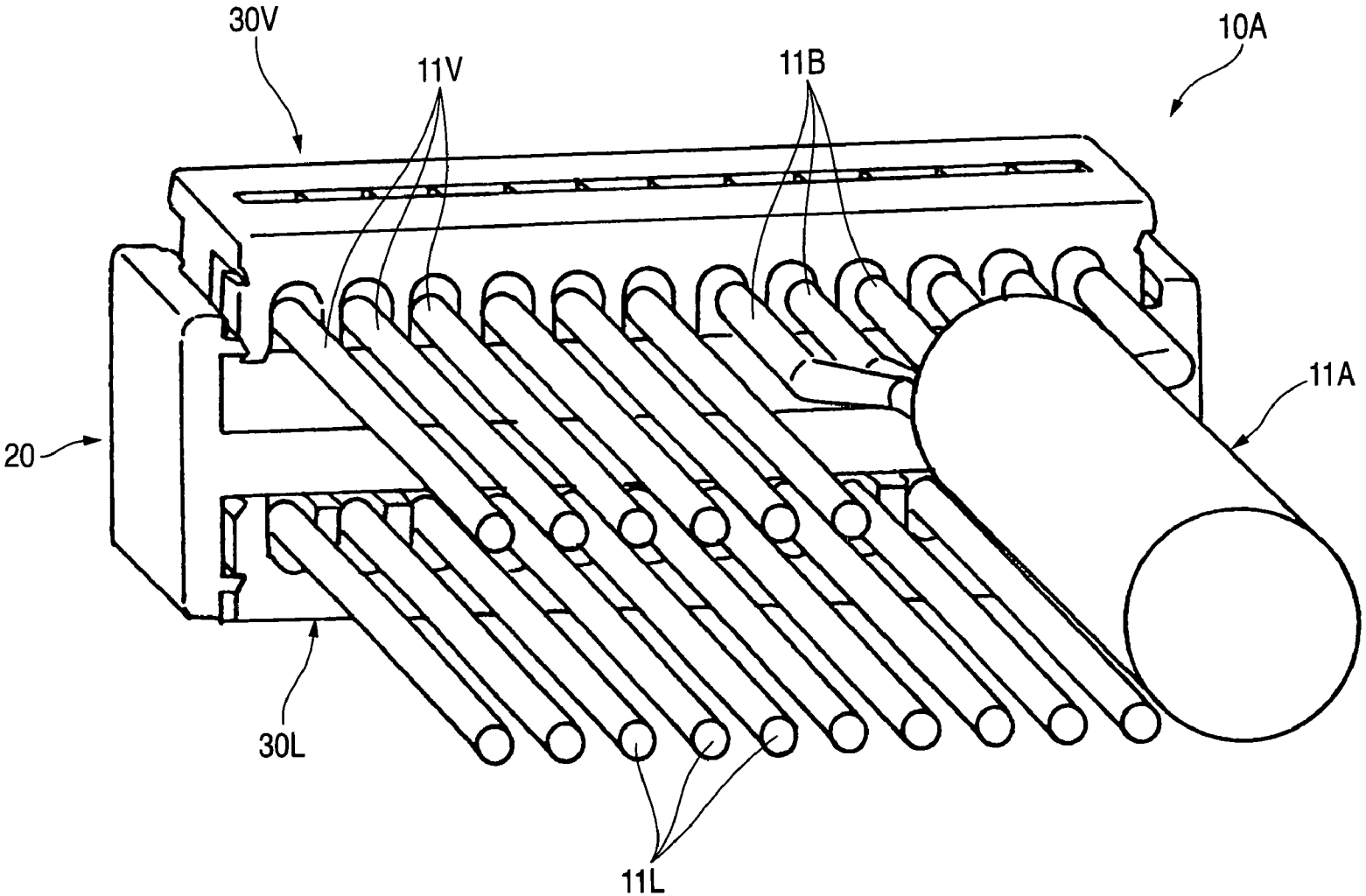
FIG. 8 is a perspective view as seen from the direction VIII in FIG. 7.

FIG. 7 is a perspective view showing a case where some of the upper wires are not compatible for automation, FIG. 8 is a perspective view as seen from a direction VIII in FIG. 7, and FIG. 9(A) to FIG. 9(C) are cross-sectional views showing procedures for attaching upper wires 11U which are not compatible for automation.

Because this press-contact connector 10A is identical to the aforementioned press-contact connector 10, the same reference numerals are given to common portions to omit overlapping description.

In this case, some of the upper wires 11U laid are those, like shield wires 1A, which cannot be made compatible for automation.

Figure 9:
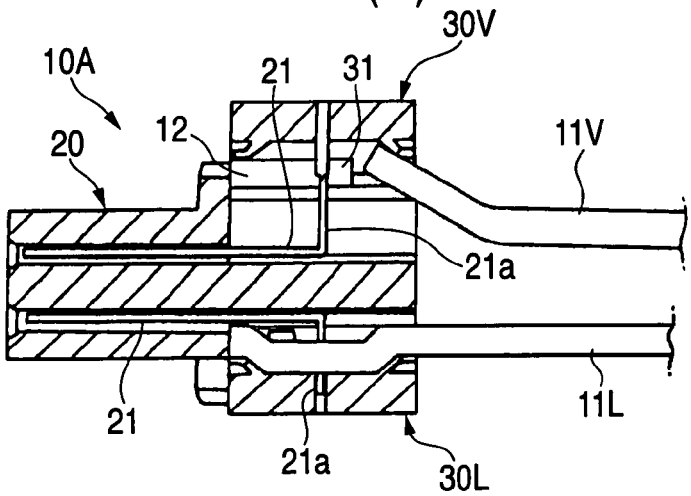
FIG. 9(A) to FIG. 9(C) are cross-sectional views showing procedures of attaching upper wires 11U which are not compatible for automation.
Figure 9:
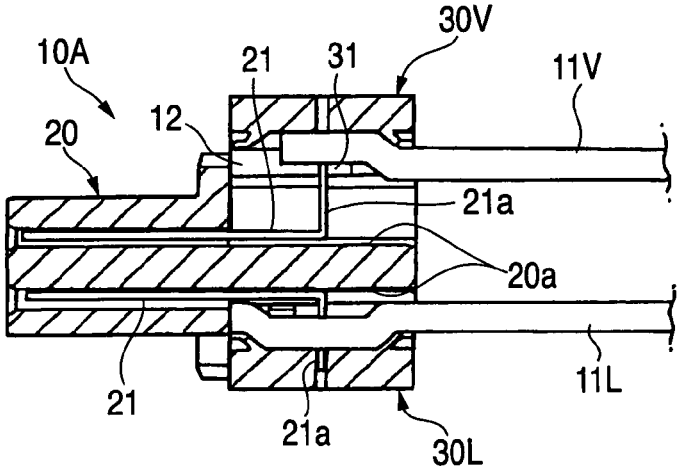
Figure 9:
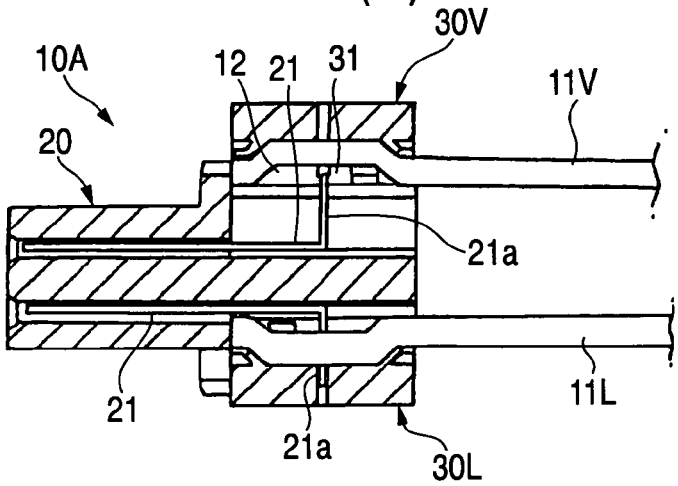

Accordingly, as shown in FIG. 9(A), in order to form a gap 12 between the upper cover 30U and housing 20, first, the engagement projections 22 of the housing 20 are engaged with the temporary engagement recesses 23 of the upper cover 30U for temporary engagement (the state in FIG. 2), and the upper cover 30U is attached in a temporary engagement state on the upper side of the housing 20.

Then, as shown in FIG. 9(B), the separated wires 11V of the shield wire 11A are inserted into the retaining portions 31 of the upper cover 30U from the tips. When the wires 11V are inserted completely, as shown in FIG. 9(C), the wires 11V are pushed downward together with the upper cover 30U, and are passed through the clearances of the press-contact blades 21*a* to engage the engagement projections 22 of the housing 20 with the actual engagement recesses 24 of the upper cover 30U.

This can allow the wires 11V to be attached to the cover 30 with sufficient holding force as shown in FIG. 3 even for the wires 11A which cannot be made compatible for automation, so that the wires 11 can be press-contacted to the terminals 21 reliably.

Figure 10:
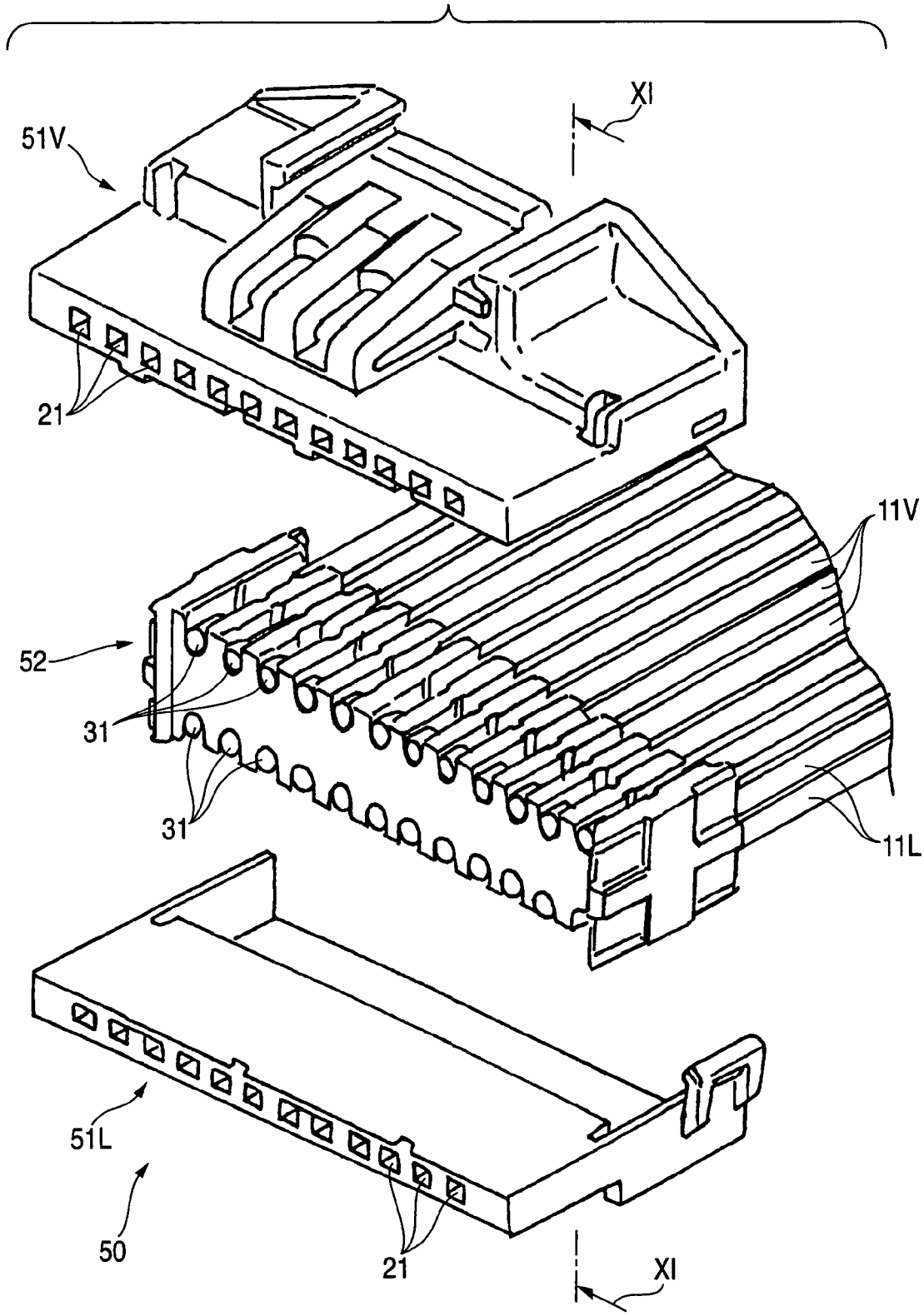
FIG. 10 is an exploded perspective view showing a modification of the press-contact connector as shown in FIG. 1.
Figure 11:
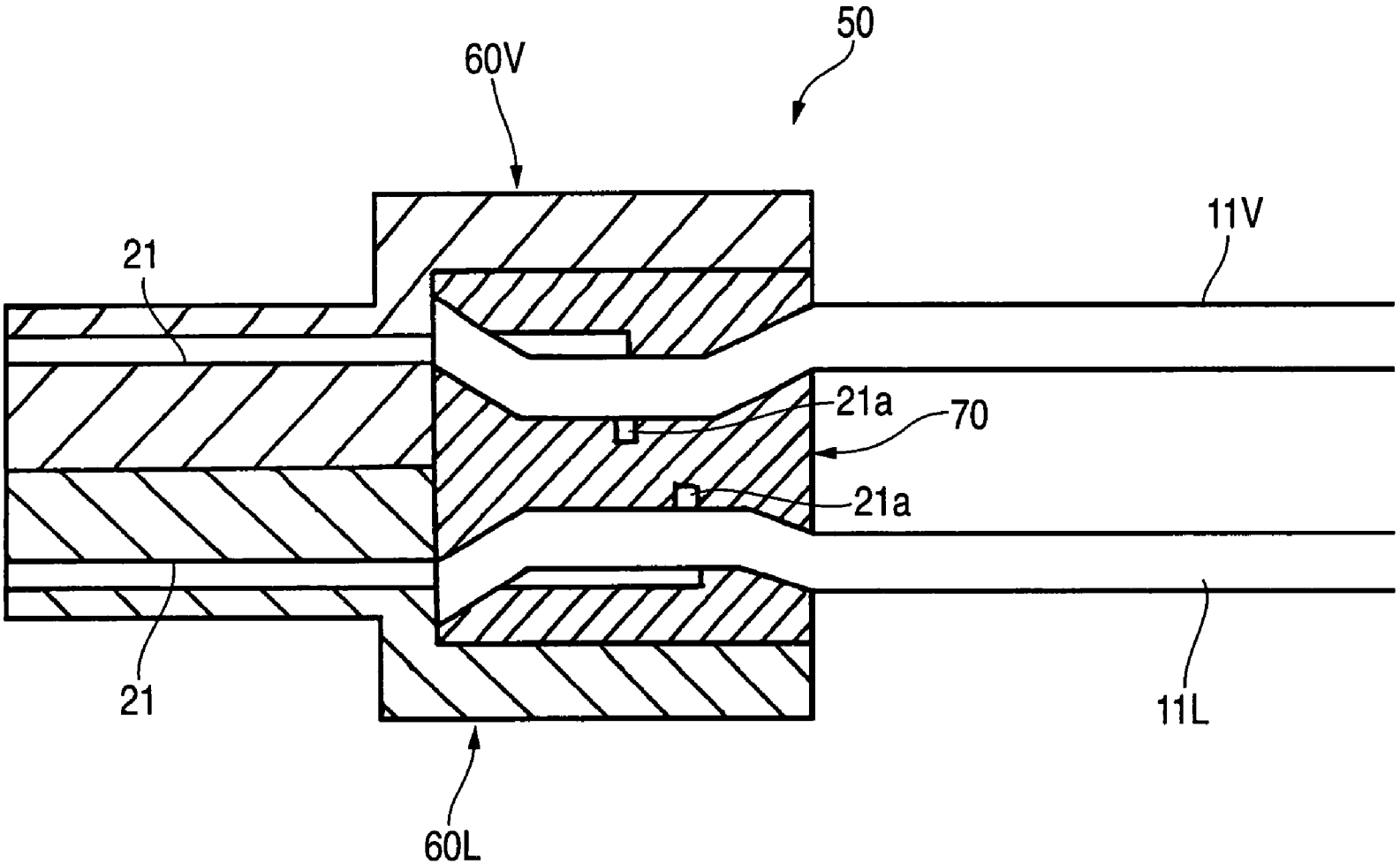
FIG. 11 is a cross-sectional view at the position XI-XI in FIG. 10.

FIG. 10 is an exploded perspective view showing a modification of the press-contact connector 10. FIG. 11 is a cross-sectional view at a position XI-XI in FIG. 10.

This press-contact connector 50 has a cover 51 as the first member and a housing 52 as the second member to which the cover 51 is attached.

While it has a pair of upper and lower covers 51U and 51L, for example, either one will do.

A plurality of terminals 21 are retained in the upper and lower covers 51U and 51L, and a plurality of press-contact blades 21*a* connected to the respective terminals 21 are provided bent inward and protruding from the top surfaces of the upper and lower covers 51U and 51L, as shown in FIG. 11.

Here, the housing 52 is provided with two stages or upper and lower terminals 21 in association with the pair of upper and lower covers 51U and 51L.

The housing 52 is provided with a plurality of retaining portions 31 for retaining wires 11, and is provided with lances 34 and claw portions 33, etc., as per the first embodiment in FIG. 4.

When the wires 11U and 11L are laid in the housing 52, therefore, the wires 11U and 11L are pressed in using the jig punch 40 as in FIG. 5, and are bent with the cooperation of the lances 34 with the claw portions 33 to be reliably held.

The covers 51U and 51L are placed over and pressed against the housing 52 holding the wires 11U and 11L from the top and bottom. Accordingly, the wires 11U and 11L are press-contacted by the press-contact blades 21*a*.

According to this press-contact connector 50, therefore, the wires 11 are held in a state bent in a U shape by the cooperation of the lances 34 and 34 with the claw portions 33 as per the press-contact connector 10 of the first embodiment, so that the wires 11 can be held at the cover 30 with sufficient holding force, and can be press-contacted to the terminals 21 reliably.

As it can be made compatible for automation, the working efficiency can be improved.

Figure 12:
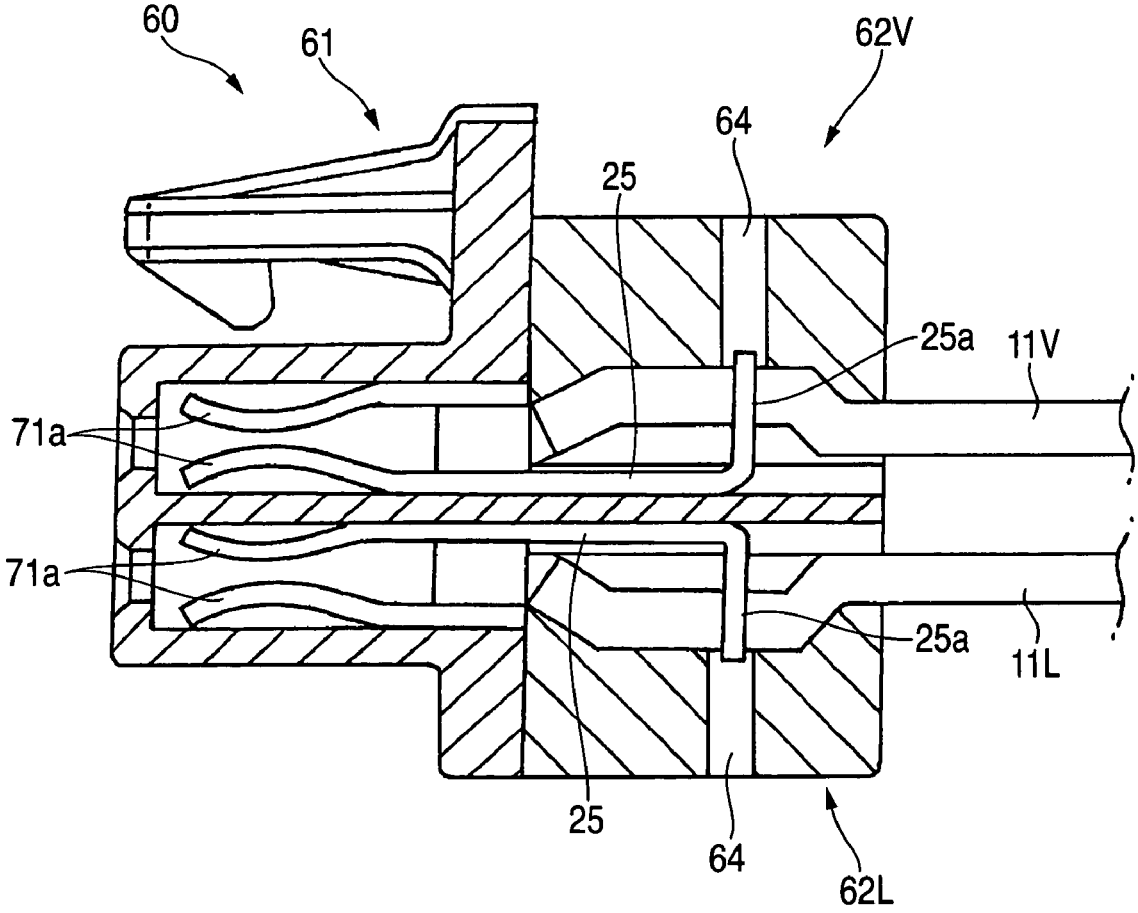
FIG. 12 is a cross-sectional view showing the second embodiment according to the invention.
Figure 13:
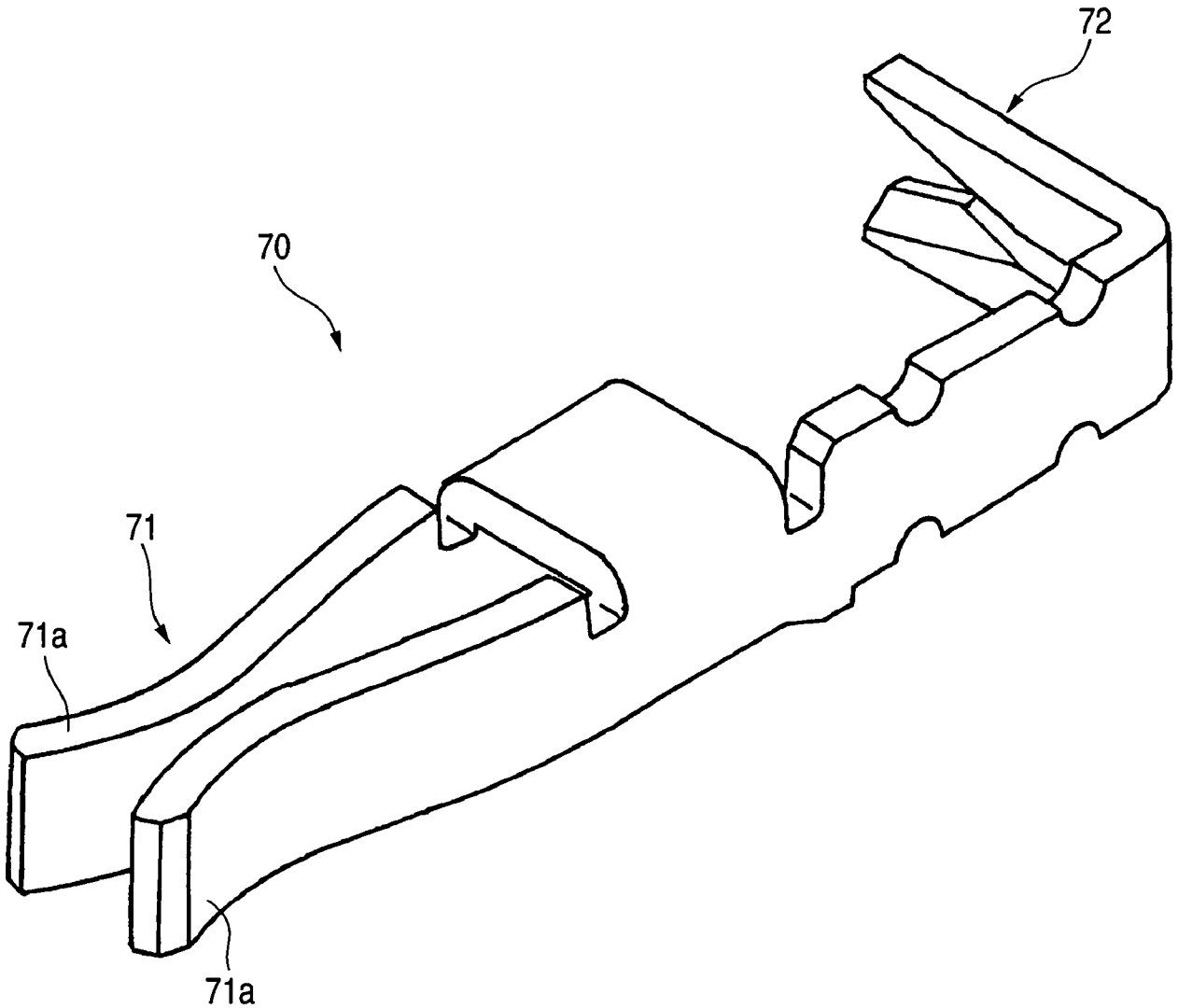
FIG. 13 is a perspective view showing one example of press-contact terminals.
Figure 14:
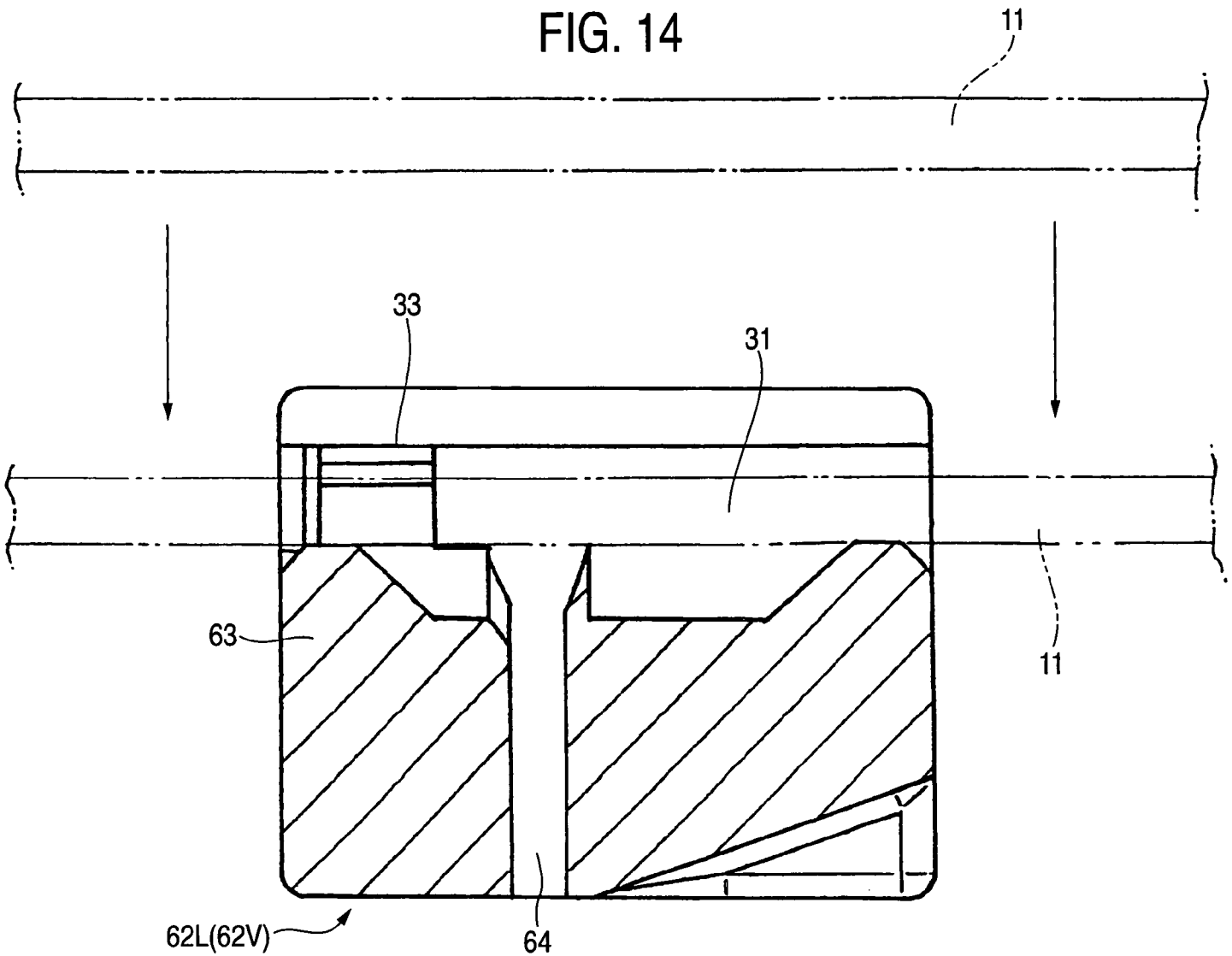
FIG. 14 is a cross-sectional view of the cover.
Figure 15:
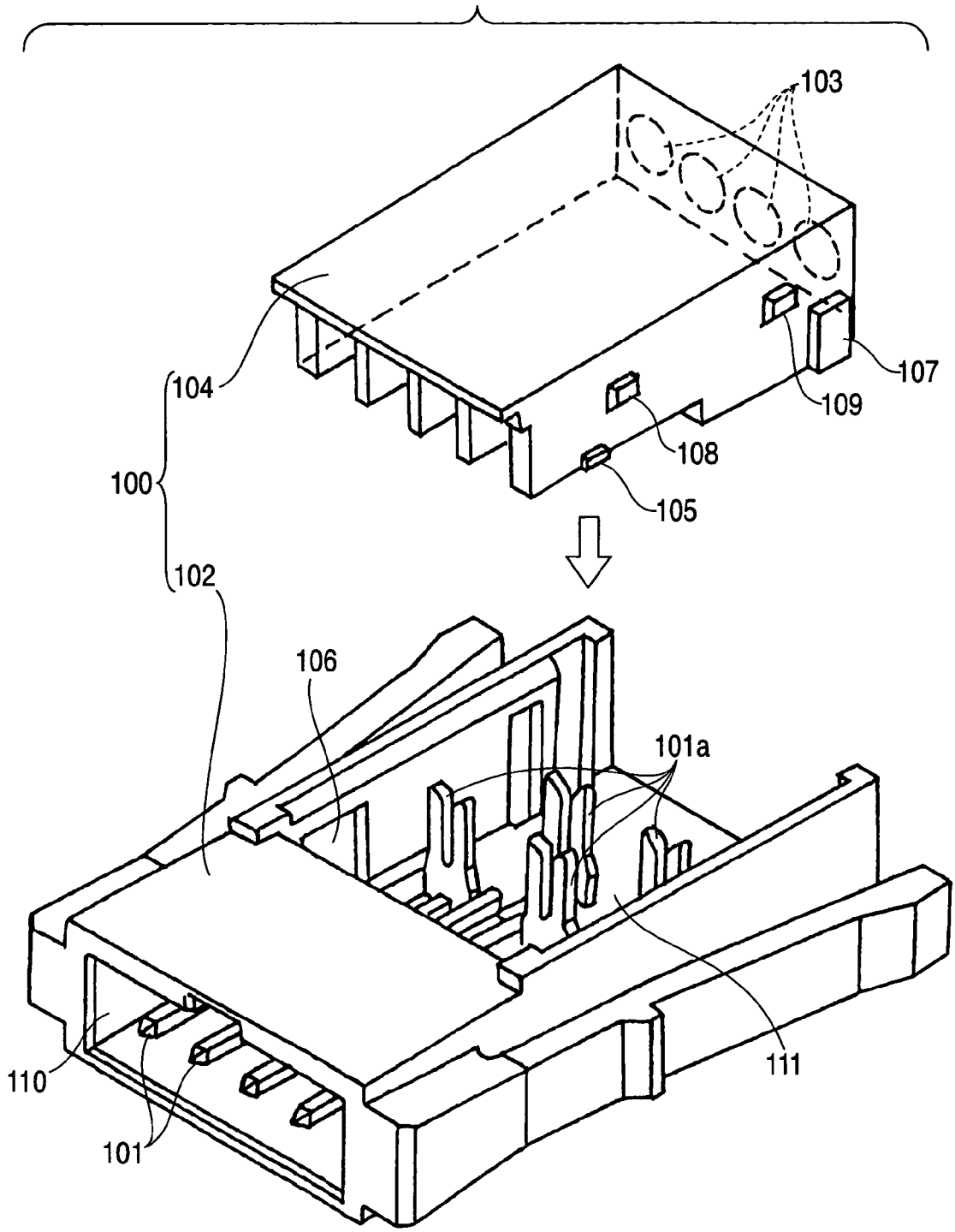
FIG. 15 is an exploded perspective view showing one example of the conventional press-contact connector.
Figure 16:
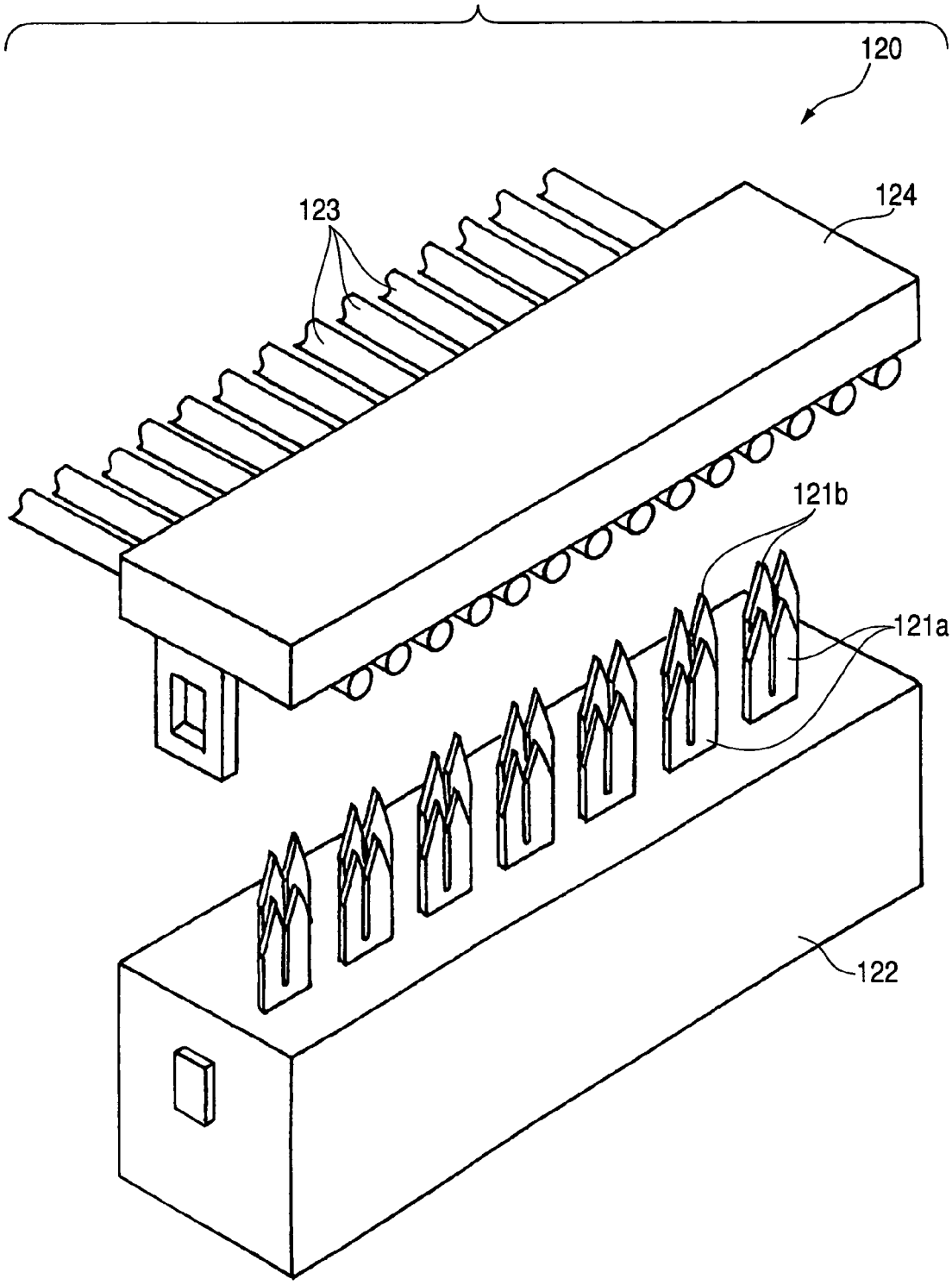
FIG. 16 is an exploded perspective view showing another example of the conventional press-contact connector.
Figure 17:
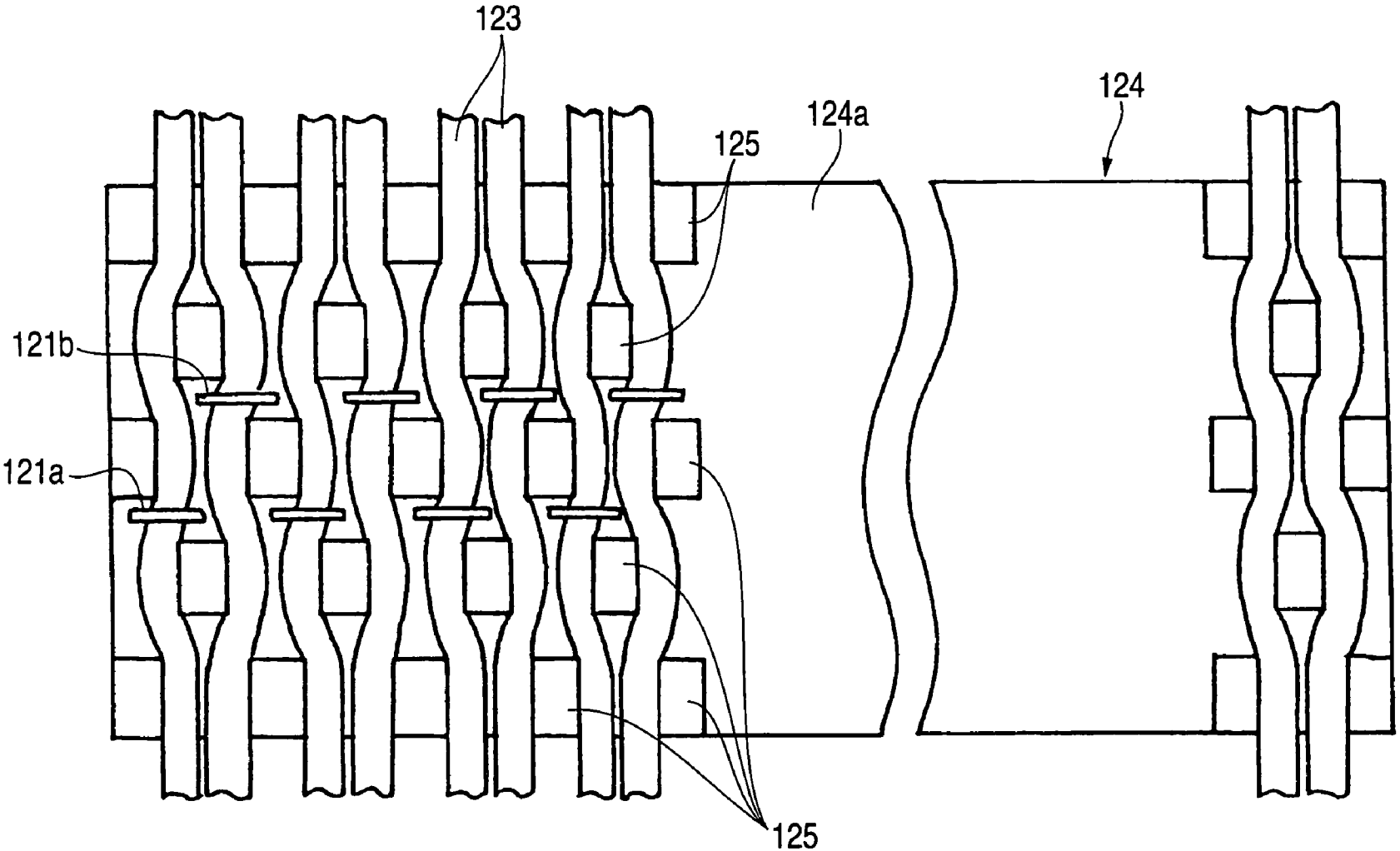
FIG. 17 is an explanatory diagram showing the layout of multiple projections provided at the press-contact cover.

Next, a third embodiment will be discussed. FIG. 12 is a cross-sectional view showing wires being connected to a press-contact connector according to the third embodiment, FIG. 13 is a perspective view of press-contact terminals used in the press-contact connector according to the third embodiment, and FIG. 14 is a cross-sectional view of the upper cover. The same reference numerals are given to those portions which are common to those of the press-contact connector according to the first embodiment to omit overlapping description.

As shown in FIG. 12, a press-contact connector 60 according to the third embodiment of the invention has a housing 61 as the first member and a housing 62 as the second member to which the housing 61 is attached. While it has a pair of upper and lower covers 62U and 62L, for example, either one will do.

As shown in FIG. 13, press-contact terminals 70 used for this press-contact connector 60 are female terminals and are provided, at the ends on one side, connection portions 71 for connection to other electrical parts or the like. The connection portion 71 has a pair of flexible connection pieces 71*a* and 71*a* which hold terminals, etc., of electrical parts or the like, for example, for conduction. A press-contact blade 72 for press-contacting with the wire 11 is provided at the other end of the press-contact terminal 70.

As shown in FIG. 14, the lower cover 62L has a rectangular cross section, and a retaining portion 31 where the wire 11 runs is provided at the upper portion, penetrating the front and rear (left and right in FIG. 14). A bulging portion 63 is provided at the retaining portion 31 downward which is the press-contacting direction. A slit 64 extending outside through the retaining portion 31 and the bulging portion 63 is provided in which a press-contact blade 25*a* is fitted (see FIG. 12). Claw portions 33 for holding the wire 11 at the retaining portion 31 are provided at left and right inner walls 32 of the retaining portion 31.

As shown in FIG. 14, therefore, to lay the wires 11 in the retaining portions 31 of the covers 30U and 30L, the wires 11 are set above the retaining portions 31 of the covers 30U and 30L as mentioned above referring to FIG. 5. Then, the wires 11 are pressed inside the claw portions 33 using the jig punch 40 so that they are held by the claw portions 33.

When the wires are held in the covers 30U and 30L this way, the covers 30U and 30L are placed over the housing 20 and mounted. At this time, the press-contact blades 21*a* are press-contacted, pressing the wires 11 outward, i.e., toward the bulging portions 63 from the retaining portions 31, so that the tip portions of the press-contact blades 21*a* are fitted in the slits 64 provided in the covers 30U and 30L. Accordingly, the wires 11 are held in a bent state inside the covers 30U and 30L, and are reliably held.

The press-contact connector 10 and 50 according to the invention is not limited to the first embodiment or the second embodiment, but can adequately be modified, improved, etc.

In addition, the shapes, sizes, modes, quantities, the number of layout locations, etc., of the first member, the second member, the temporary engagement lock units, the actual engagement lock units, the retaining portion, etc., illustrated in the above described embodiments can be arbitrary and are not restrictive.

What is claimed is:

1. A press-contact connector comprising:

a first member accommodating a plurality of terminals;

a plurality of press-contact blades connected to the terminals and protruding from the first member;

a second member attached to the first member in such a way as to cover the press-contact blades and holds a plurality of wires to press-contact with the press-contact blades in an aligned state, the second member including:

a plurality of retaining portions capable of retaining the wires respectively, formed in an approximate U shape and arranged in parallel to one another;

claw portions provided at inner walls of the retaining portions to hold the wires in the retaining portions, wherein the wires are connected to the press-contact blades with the wires in a bent state in the retaining portions, such that the wires respectively have a segment in the retaining portions that is bent on opposite sides of the press-contact blades, wherein the retaining portions include lances formed thereon and extending outwardly from the retaining portions at opposite axial ends of the retaining portions to urge the wires toward openings of the retaining portions in a cross section, and wherein the lances are provided in the retaining portions at the opposite sides of the press-contact blades.

2. The press-contact connector according to claim 1, further comprising:

temporary engagement lock units capable of temporarily locking the second member with respect to the first member; and actual engagement lock units capable of actually locking the second member with respect to the first member from a temporarily locked state.

3. The press-contact connector according to claim 1, wherein the claw portions are provided between one of the lances and the press-contact blades in the retaining portions respectively.

4. The press-contact connector according to claim 1, wherein the segment includes a middle portion joining two angled portions.

5. The press-contact connector according to claim 4, wherein the middle portion is flush with a bottom wall of the retaining portions.

* * * * *